US009480355B2

(12) United States Patent
Manidis et al.

(10) Patent No.: US 9,480,355 B2
(45) Date of Patent: Nov. 1, 2016

(54) UNDERGARMENT ORGANIZING DEVICE AND METHOD OF USE

(71) Applicants: Renee Kimberley Manidis, Boynton Beach, FL (US); Thomas More Manidis, Boynton Beach, FL (US)

(72) Inventors: Renee Kimberley Manidis, Boynton Beach, FL (US); Thomas More Manidis, Boynton Beach, FL (US)

( * ) Notice: Subject to any disclaimer, the term of this patent is extended or adjusted under 35 U.S.C. 154(b) by 945 days.

(21) Appl. No.: 13/685,769

(22) Filed: Nov. 27, 2012

(65) Prior Publication Data

US 2014/0144951 A1 May 29, 2014

(51) Int. Cl.
*A47G 25/66* (2006.01)
*A47G 25/14* (2006.01)

(52) U.S. Cl.
CPC ..... *A47G 25/66* (2013.01); *A47G 2025/1492* (2013.01)

(58) Field of Classification Search
CPC ..... A47G 25/66; A47G 2025/1492; A45C 13/03; B65D 85/18
See application file for complete search history.

(56) References Cited

U.S. PATENT DOCUMENTS

| | | | | |
|---|---|---|---|---|
| 380,174 | A | 3/1888 | Bowles | |
| 3,540,576 | A | 11/1970 | Pierce et al. | |
| 4,733,806 | A | 3/1988 | Sloop | |
| 5,154,544 | A | 10/1992 | Arendt | |
| 5,269,090 | A | 12/1993 | Richards et al. | |
| 5,369,892 | A | 12/1994 | Dhaemers | |
| 5,396,991 | A | 3/1995 | Lachambre | |
| 5,597,099 | A * | 1/1997 | Sharp | A47G 25/66 223/61 |
| 5,931,319 | A | 8/1999 | Murphy | |
| 6,685,023 | B2 | 2/2004 | Bleggi et al. | |
| D539,581 | S | 4/2007 | Upadhye | |
| D631,251 | S | 1/2011 | Hong | |
| D644,042 | S | 8/2011 | Tower | |
| 8,047,410 | B2 | 11/2011 | Holm et al. | |
| 2007/0056997 | A1 * | 3/2007 | Radtke | A47G 25/20 223/84 |
| 2007/0266740 | A9 * | 11/2007 | Kendall | D06F 29/00 68/3 R |
| 2012/0068377 | A1 | 3/2012 | Malone | |
| 2012/0292209 | A1 * | 11/2012 | Willey | A47G 25/14 206/279 |
| 2013/0087587 | A1 * | 4/2013 | Hickey | A47G 25/18 223/88 |
| 2014/0144951 | A1 * | 5/2014 | Manidis | A47G 25/66 223/84 |

* cited by examiner

*Primary Examiner* — Shaun R Hurley
*Assistant Examiner* — Andrew W Sutton
(74) *Attorney, Agent, or Firm* — The Concept Law Group, P.A.; Scott D. Smiley; Mark C. Johnson

(57) ABSTRACT

An undergarment organizing device having a frame having an inner surface and outer surface, and a first, second, and third retention member that extend outwardly away from the inner surface of the frame, the first retention member having a first undergarment support surface, the second retention member located beyond the first retention member and having a second undergarment support surface, and the third retention member being located beyond the first retention member, having a third undergarment support surface, and being slidable in a direction away from the second support surface.

20 Claims, 8 Drawing Sheets

100

100

A-A

100

100

600

700

UNDERGARMENT ORGANIZING DEVICE AND METHOD OF USE

FIELD OF THE INVENTION

The present invention relates generally to garment organizers, and, more particularly relates to undergarment organizers for use with thongs and panties.

BACKGROUND OF THE INVENTION

It is well known that undergarments are utilized by most, if not all, people. For most people, undergarments are organized and placed in one or more drawers of a dresser. Undergarments are also typically placed on door knobs, dresser drawer knobs, and shower curtain rods. For most men, the process of organizing and storing their undergarments is unremarkable and renders the user very little storing issues. For many women, storing and organizing undergarments, such as panties or thongs, can be problematic. This due in part to the shape and fabric of most panties or thongs, e.g., thins pieces of fabric in the rear of the undergarment, as the shape facilitates them to bunch and tangle when placed in a drawer together. Bunching and tangling also often occurs when the panties or thongs are removed from a dryer or are wet. When the panties and thongs are bunched together they generally take up more space and difficult to untangle. This creates an inefficient and timely process for a user to store and remove a thong or panty.

Some known undergarment organizers utilize dividers to partition drawers and cabinets into sections, wherein a user places certain undergarments in those sections created by the dividers. These organizers, however, do not prevent bunching and tangling of the panties or thongs. Moreover, these organizers take up considerable amounts of space and offer users limited versatility as they are sized for the particular dimensions of the drawer. Other known undergarment organizers utilize hangers to support and store panties or thongs. These hangers hold a very limited number of undergarments and are also not operable, or at least very difficult, to use in combination with dresser drawers—where most undergarments are stored. Further those known hanger organizers are not able to be stacked together to maximize spatial efficiency.

Other known organizers utilize large cumbersome boxes that have a plurality of pegs or dowels that maybe used to hang or store objects. These organizers suffer from many of the disadvantageous as the above undergarment organizers as they consume significant amounts of space thereby limiting the areas they can be stored and used. Moreover, many of these organizers have pegs that are permanently attached to the device making it difficult, if not impossible, to apply tension to the undergarment. As such, the panties and thongs continue to bunch and tangle together. Those organizers that do have the ability to interchange and remove pegs only provide a user with limited versatility as they are only adjustable for one size of undergarment and are only adjustable in certain spatial increments. Therefore, the organizer may be set for one size of undergarment and any other sized undergarment would either be too big—such that the undergarment could not be retained by the organizer—or would be too small—such that the undergarment would plastically deform, thereby damaging the material. In addition, many of those organizers using pegs are also very time-intensive to set-up and adjust.

Many of the organizers using pegs also have the pegs spaced closely together such that undergarments cannot be effectively stored. As undergarments contour the crotch and waist of a person, they are triangularly shaped. This shape is problematic for many organizers as they have hangers, dowels, or pegs arranged in closely-aligned square matrixes. This causes some of the pegs to apply outwardly pressure on the undergarments when coupled to the organizer. The outwardly-applied pressure thereby increases the likelihood that the undergarment becomes dislodged from the organizer or that the undergarment becomes damaged from the pegs puncturing the undergarment.

Some known clothing organizers that employ the use of pegs/dowels in square matrixes, and also many that do not, only provide two retention members, e.g., pegs/dowels, which are spaced vertically apart. Because of the shape of undergarments, they still cause the undergarment to tangle and bunch close together. This generates problems with effectively storing and removing the undergarments. In addition, because many users desire to air dry panties or thongs, it will also prevent the undergarments from efficiently drying as the undergarments will be bunched together, thereby exposing less surface area to the environment. Furthermore, most known clothing organizers, specifically those capable of retaining and storing undergarments, are unable or at least very difficult to be used in transporting those undergarments, e.g., in luggage.

Therefore, a need exists to overcome the problems with the prior art as discussed above.

SUMMARY OF THE INVENTION

The invention provides an undergarment organizing device and method of use that overcomes the hereinaforementioned disadvantages of the heretofore-known devices and methods of this general type and that efficiently and effectively stores panties and thongs without bunching or tangling.

With the foregoing and other objects in view, there is provided, in accordance with the invention, an undergarment organizing device that has a frame with an inner surface and outer surface, a first retention member extending outwardly away from the inner surface of the frame, the first retention member having a first undergarment support surface, a second retention member extending outwardly away from the inner surface of the frame, the second retention member located beyond the first retention member and having a second undergarment support surface, and a third retention member extending outwardly away from the inner surface of the frame, the third retention member located beyond the first retention member, having a third undergarment support surface, and being slidable in a direction away from the second support surface.

In accordance with a further feature of the present invention, the first, second, and third retention members are positioned on the frame in a triangular-like configuration.

In accordance with another feature of the present invention, the first retention member is slidable in a direction away from both the second and third retention members.

In accordance with an additional feature of the present invention, the second retention member is slidable in a direction away from the third support surface.

In accordance with a further feature of the present invention, the frame is substantially slender.

In accordance with another feature, an embodiment of the present invention includes an upper retention member coupled substantially at a distal end of at least one of the first, second, and third retention members, the upper retention member extending in a direction outwardly away from the undergarment support surface of the at least one of the first, second, and third retention members.

In accordance with yet another feature, an embodiment of the present invention also includes a second undergarment organizing device, an outer surface of the second undergarment organizing device having a first portion and a second portion, wherein the first and second portions are shaped to couple with the undergarment organizing device.

In accordance with the present invention, an undergarment organizing device includes a frame having an inner surface and outer surface and at least three retention members with each (1) extending in a direction outwardly away from the inner surface of the frame, (2) one of the at least three retention members coupled to a first portion of an undergarment, (3) one of the at least three retention members coupled to a second portion of the undergarment, the second portion of the undergarment located beyond the first portion of the undergarment, (4) one of the at least three retention members coupled to a third portion of the undergarment, the third portion of the undergarment located beyond the first portion of the undergarment, and (5) one of the at least three retention members being operable to slidably engage with the undergarment to at least partially place the undergarment in a dynamic state.

In accordance with a further feature of the present invention, two of the at least three retention members are operable to slidably engage with the undergarment to at least partially place the undergarment in the dynamic state.

In accordance with yet another feature of the present invention, three of the at least three retention members are operable to slidably couple with the undergarment to at least partially place the undergarment in the dynamic state.

In accordance with an additional feature of the present invention, one of the at least three retention members is slidably biased toward an edge of the frame.

In accordance with a further feature of the present invention, two of the at least three retention members are slidably biased toward an edge of the frame.

In accordance with the present invention, a method of the storing and retaining undergarments is disclosed that includes providing an undergarment organizing device, wherein the undergarment organizing device has a frame with an inner surface and an outer surface and a first retention member, a second retention member located beyond the first retention member, and a third retention member located beyond the first retention member and being slidable in a direction toward an outer frame edge, the first, second, and third retention members extending in a direction outwardly away from the inner surface of the frame. The method also includes coupling the first retention member to a first portion of an undergarment, coupling the second retention member to a second portion of the undergarment, and slidably coupling the third retention member to a third portion of the undergarment.

In with another embodiment of the present invention, wherein the second retention member is slidable in a direction toward an outer frame edge, the method includes slidably coupling the second retention member to the second portion of the undergarment.

In with another embodiment of the present invention, wherein the first retention member is slidable in a direction toward an outer frame edge, the method also includes slidably coupling the third retention member to the third portion of the undergarment.

Although the invention is illustrated and described herein as embodied in an undergarment organizing device, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to the general direction from the first retention member toward the third retention member.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
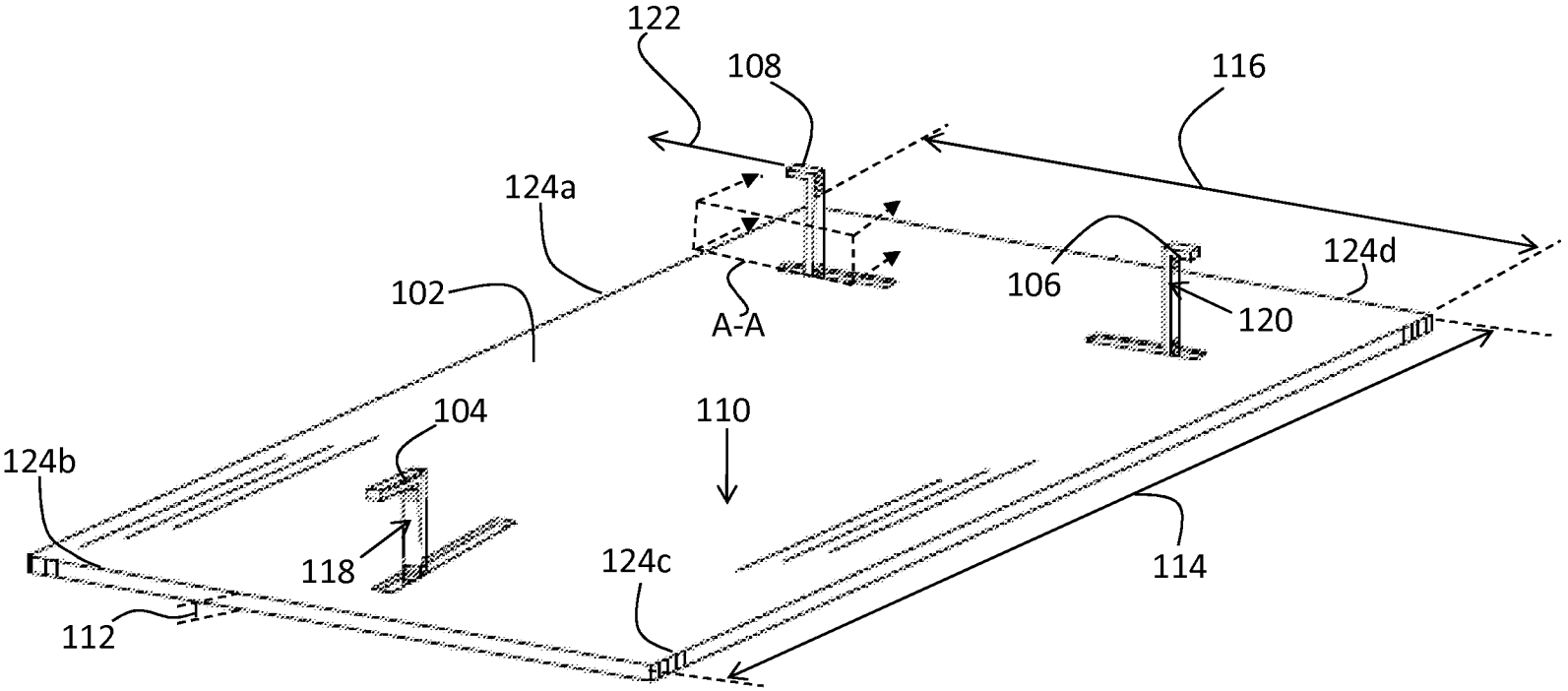
FIG. 1 is a perspective view of an undergarment organizing device with a first, second, and third retention member in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient undergarment organizing device and method of use that effectively and efficiently stores undergarments, specifically thongs and panties. Although the present invention is primarily aimed at facilitating the storage and removal of panties and thongs, it may also be employed to effectively store and organize any undergarment. Embodiments of the invention provide an undergarment organizing device that applies surface tension to one or more undergarments, thereby preventing bunching and tangling.

Referring now to FIG. 1, one embodiment of the present invention is shown in a perspective downward-looking view. FIG. 1 shows several advantageous features of the present invention, but, as will be described below, the invention can be provided in several shapes, sizes, combinations of features and components, and varying numbers and functions of the components. The first example of an undergarment organizing device, as shown in FIG. 1, includes a frame 102 and at least three retention members 104, 106, 108. In one embodiment, the lower of the three retention members 104, 106, 108 is also referred to herein as the first retention member 104. The two retention members 106, 108 positioned above the first retention member 104 are also referred to herein as the second and third retention members 106, 108, respectively. In other embodiments, the second and third retention members 106, 108 may be interchangeable, such as that the second retention member 106 may be the third retention member 108, or the device 100 may have more than three retention members.

The frame 102 can be seen having an inner surface 110 and outer surface 200 (shown in FIG. 2), with the three retention members 104, 106, 108 extending in a direction outwardly away from the inner surface 110 of the frame 102. In one embodiment, the frame 102 is made from a polymer-based material that is substantially resilient and light-weight, such as polyethylene, poly (vinyl chloride), polystyrene, or other polymers. In other embodiments, the frame 102 may be made from composites, metals, or other materials capable of supporting the weight of multiple undergarments. Separating the inner and outer surfaces 110, 200 is a thickness 112 which is smaller in length than the height 114 of the frame 102. As such, the frame 102 may be generally referred to as being substantially slender. This allows the device 100 to be utilized in combination with virtually any sized dresser drawer or cabinet. Moreover, the size of the frame 102 allows the device 100 to be easily and effectively transported. In one embodiment, the height 114 to thickness 112 ratio is approximately 15:1. In other embodiments, the ratio may be more or less than 15:1 depending on the application of the device 100 and any other factor pertinent to the user. Moreover, the frame 102 may be hollow, wherein the inner and outer surfaces 110, 200 are attached together using posts or other supporting structure. In other embodiments, the frame 102 may define slots or sections where the retention members 104, 106, 108, or other components, are positioned.

The second and third retention members 106, 108 can be seen positioned beyond the location of the first retention member 104. In one embodiment, the second and third retention members 106, 108 are horizontally aligned along the height 114 of the frame 102. In other embodiments, the second and third retention members 106 are not horizontally aligned along the height 114 of the frame 102, but are still separated horizontally (along the width 116 of the frame 102) by the first retention member 104. In further embodiments, the at least three retention members 104, 106, 108 are positioned on the frame in a triangular-like configuration, as shown in FIG. 1. Said another way, the at least three retention members 104, 106, 108 have two of the three members located above another and if a line is drawn connecting a point on each retention member, there would be three sides. This advantageously allows the device 100 to effectively store undergarments, such as panties and thongs without any other retention members obstructing the undergarment.

Each of the retention members 104, 106, 108 have undergarment support surfaces 118, 120, 202 (shown in FIG. 2), respectively. The undergarment support surfaces 118, 120, 202 are surface areas of the retention member where the undergarment is supported and retained. Any portion of the retention member may be considered a support surface if it is capable of contacting the undergarment. In one embodiment, the support surfaces 118, 120, 202 are planar. In other embodiments, the support surfaces 118, 120, 202 may be curved or may be in another shape or orientation.

In one embodiment, the device 100 beneficially provides tension to the undergarment while being stored/retained by having the third retention member 108 being slidable in a direction away from the second support surface 120. This general direction is represented by the arrow 122 in FIG. 1. As the third retention member 108 moves away from the surface 120 of the second retention member 106 the undergarment is pulled, subjecting it to tension. The tension advantageously prevents the undergarment from bunching or tangling with other undergarments that are retained by the device 100, in addition to subjecting the surface area of the undergarment to the environment. In one embodiment, the direction of the movement for the third retention member 108 is approximately 180° from one or more points along the second support surface 120. In other embodiments, the direction of movement involves some x-component away from one or more points along the second support surface 120.

In addition, other embodiments of the present invention provide a device 100 where the one of the retention members 104, 106, 108 is slidable in direction toward one or more edges 124*a-d* of the frame 102. Opposed to the third retention member 108 sliding in a direction away from the second support surface 120, one or more of the retentions members may be operable to slide towards an edge, e.g., preferably an adjacent frame edge 124*a*, of the frame 102. The terms "slidable," "slidably," or "slide" are defined as any lateral movement (or potential lateral movement), with respect to any of the frame edges 124*a-d*.

Figure 2:
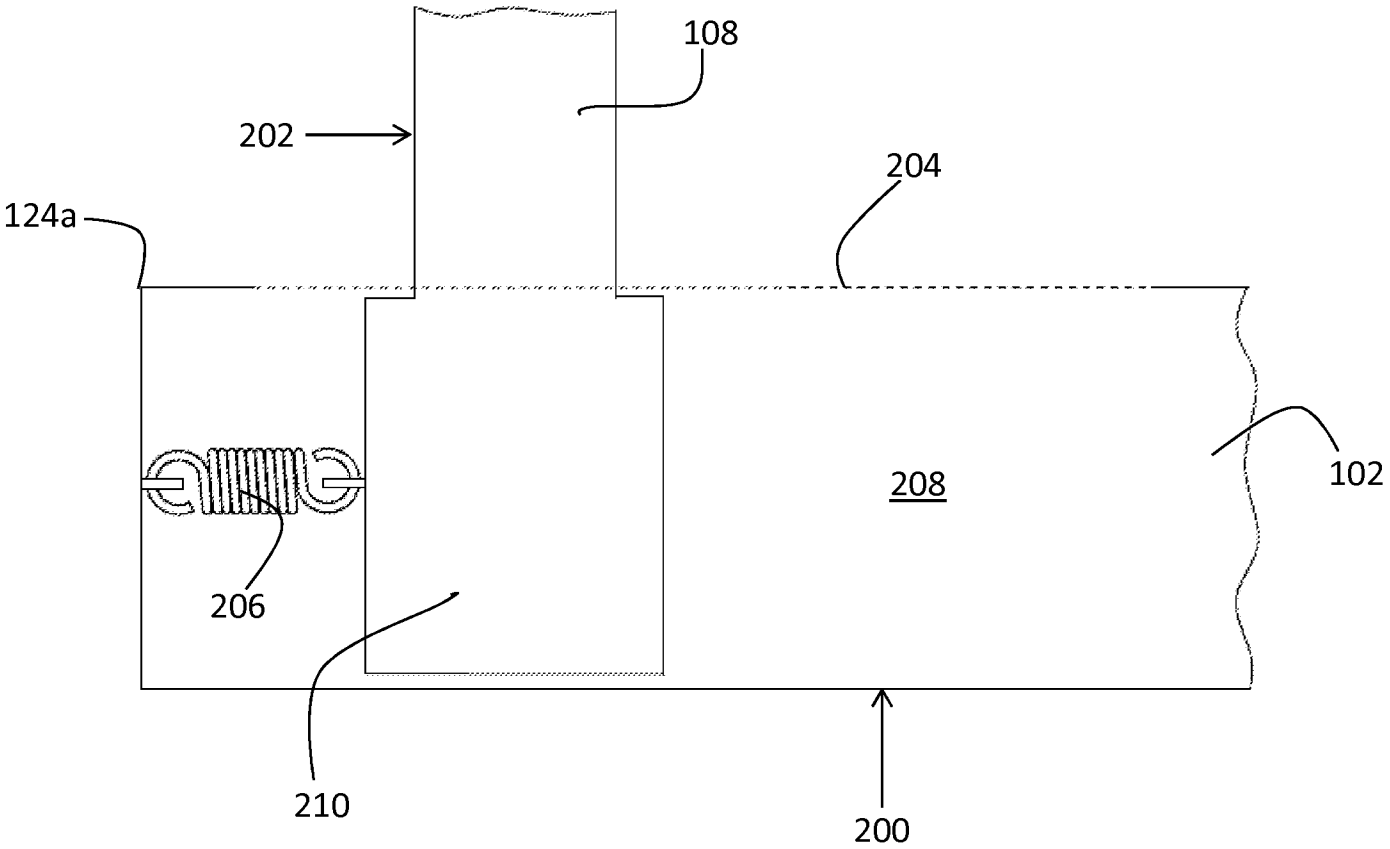
FIG. 2 is a cross-sectional view of a slidable retention member of FIG. 1 in accordance with one embodiment of the present invention.

With reference now to FIGS. 1 and 2, one exemplary method of sliding the third retention member 108 is shown. More specifically, FIG. 2 illustrates a cross-sectional view of the frame 102 where the third retention member 108 is coupled. In one embodiment, the third retention is slidably biased toward one or more frame edges, e.g., 124*a*. A retention member, e.g., the third retention member 108, may be slid within one or more slots 204 defined by the frame 102. As shown in FIG. 2, the third retention member 108 is slidably biased using a spring 206 that has one end coupled to the third retention member 108 and another end coupled to the frame 102. In one embodiment, the spring 206 may have a spring constant "k," sufficient to apply a resultant force capable of stretching and retaining one or more undergarments and easily allowing the user to pull the retention member 108 back. As such, the retention member 108 be may be moved toward the second support member 106 to place the undergarment on, and then moved away from the second support member 106 to apply tension to the undergarment. In other embodiments, one or more of the retention members 104, 106, 108 may be moved and locked into place utilizing notches or groves in predefined spatial increments.

As shown in FIG. 2, the third retention member 108 may be slidable within a channel 208 defined by the frame 102, with the channel 208 providing space for the retention member 108 to move. In one embodiment, the retention member 108 may have a lower portion 210 sized larger than the slot 204 such that the retention member 108 does not pull up through the slot 204. In other embodiments, the retention member 108 may be coupled to a piece of the frame 102 that allows it to slide, but also prevents the retention member 108 to tilt when exposed to counter acting forces produced by the undergarments. The retention member 108 may also utilize bearings or other components to facilitate movement of the member 108 within the channel 208.

With reference back to FIG. 1, in addition to the third retention member 108 being slidable, the first and second retention members 104, 106 may also be slidable. The retention members 104, 106, 108 may be slidable according to the embodiment shown in FIG. 2, or any other embodiment described herein. The retention members 104, 106, 108 are slid to a position that advantageously subjects an undergarment to tension. The second retention member 106 may be operable to be slidable in a direction away from the third support surface 202. The first retention member 104 may also be operable slide in a direction away from both the second and third retention members 106, 108. One, two, three, or a combination of retention members may be slidably used to exert tensional force on the undergarment thereby keeping it retained and incapable of tangling with other undergarments.

Figure 3:
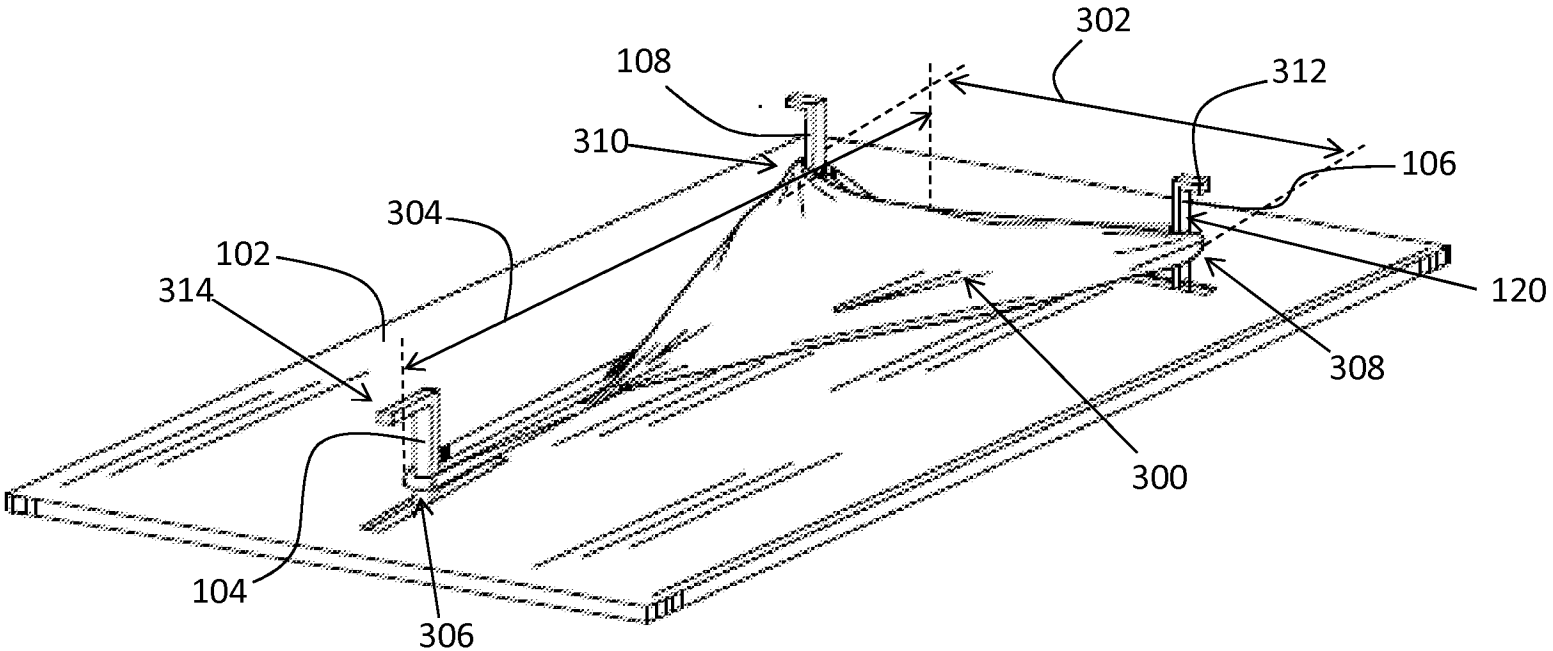
FIG. 3 is a perspective view of an undergarment device of FIG. 1 with an undergarment coupled to each retention member in accordance with the present invention.

With reference now to FIG. 3, the at least three retention members 104, 106, 108 are shown coupled to an undergarment 300, specifically a thong. An average-sized thong shaped for a person with a 27-28 inch waist has a diameter/width 302 of about 8.5 inches. The height 304 of the thong ranges from about 9-11 inches, i.e., one or more portions of the waist seam to one or more portions of the crotch. As such, in one embodiment, one or more of the retention members 104, 106, 108 are configured in positions where the undergarment may be placed around the retention members 104, 106, 108, while being in a static state, or having little or no tensional force. Said another way, the undergarment 300 is in a static state when the net force acting on the undergarment 300 is approximately zero. This would require the retention members 104, 106, 108 to be positioned apart from each other distances that are lower than the dimensions of the undergarment 300. For example, the second and third retention members 106, 108 would be spaced apart approximately 8 inches, while the first retention member 104 would be spaced about 8 inches from one or more of the second and third retention members 106, 108. In other embodiments, the configuration and dimensions of the retention members 104, 106, 108 maybe more or less than the above-described dimensions, dependent at least partially on the undergarment 300 being retained.

After the undergarment 300 is placed on the retention members 104, 106, 108, or at least two of the three retention members 104, 106, 108, one or more of the retention members 104, 106, 108 is slid to generate tensional force on the undergarment 300, thereby placing the undergarment in a "dynamic state." When the undergarment is in a dynamic state, the net force acting on the undergarment 300 is greater than zero. In some embodiments, depending on the configuration and slidability of the retention members 104, 106, 108, the undergarment 300 may be in a dynamic state as the user is coupling the undergarment 300 to the retention members 104, 106, 108.

In one exemplary embodiment, shown in FIG. 3, a user first couples one of the retention members 104, 106, 108 to a first portion 306 of the undergarment 300. The user then couples a second portion 308 of the undergarment 300 to one of the retention members 104, 106, 108. The user will then couple a third portion 310 of the undergarment 300 to another of the retention members 104, 106, 108. As typical thongs and G-strings are shaped triangularly, the second and third portions 308, 310 of the undergarment 300 are located beyond the first portion 306. After the undergarment 300 is coupled to all three retention members 104, 106, 108, one of the retention members 104, 106, 108 is slid to at least partially place the undergarment in the dynamic state. If one or more of the retention members 104, 106, 108 are slidably biased, then a user may be required to apply a force sufficient to move those retention members in a position that effectively allows the retention members to couple with the undergarment 300. As undergarment 300 is in contact with other retention members, one or more of the other retention members 104, 106, 108 may also subject the undergarment 300 to tensional force(s). Said another way, one or more other retention members 104, 106, 108, may also place the undergarment 300 in a dynamic state. In one embodiment, placing the undergarment 300 in a dynamic state may occur by slidably engaging the retention member with the undergarment 300. In other embodiments, this may occur by an equal and opposite force exerted on the undergarment 300 from a stationary retention member.

In another embodiment of the present invention, one or more of the retention members 104, 106, 108 may have an upper retention member 312 coupled substantially at the distal end 314 of at least one of the first, second, and third retention members 104, 106, 108. The upper retention member 312 extends in a direction outwardly away from one or more portions of the undergarment support surface, e.g., the second support surface 120, of the at least one of the first, second, and third retention members 104, 106, 108. Although the upper retention member 312 is shown on all three retention members 104, 106, 108, it may be on one, or more than one, of the retention members 104, 106, 108. As the undergarments are prone to slide upwardly along a retention member, especially when placed in a dynamic state, the upper retention member 312 prevents the undergarment 300 from become dislodged from the device 100. This benefits a user as multiple undergarments 300 may be placed on the device 100 at one time with a small probability of them becoming dislodged.

In further embodiments, the device 100 may have a plurality of first, second, and third retention members 104, 106, 108 placed on the frame 102. This advantageously allows a user to place an even greater amount of undergarments 300 on the device 100 at one time. The plurality of retention members 104, 106, 108 may be below or beyond one another, or may be adjacent, i.e., left and right, to one another.

Figure 4:
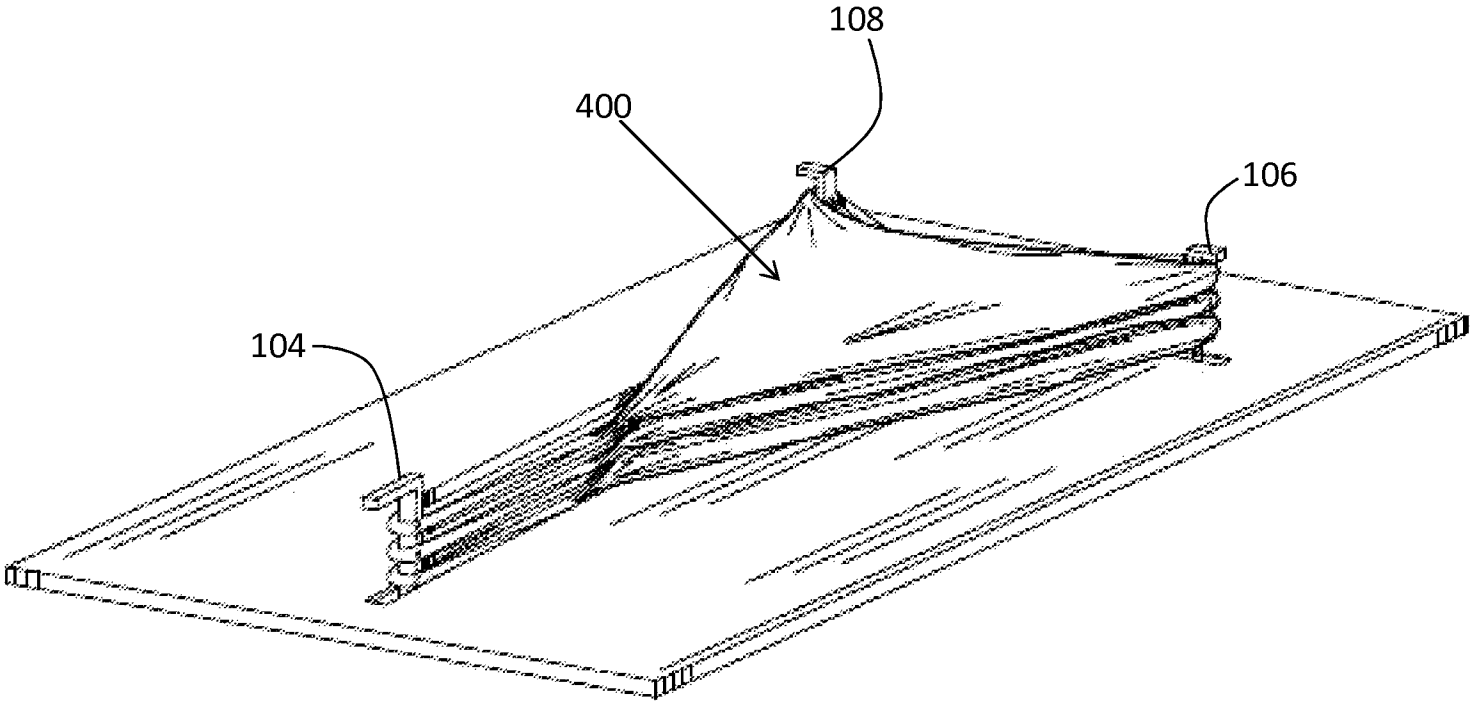
FIG. 4 is a perspective view of an undergarment device of FIG. 1 with a plurality undergarments coupled to each retention member in accordance with the present invention FIG. 5 a perspective partially-hidden view of the undergarment device of FIG. 1 with a second undergarment device stacked on top, in accordance with one embodiment of the present invention.

With reference to FIG. 4, in one embodiment the retention members 104, 106, 108 may be elongated to allow a plurality of undergarments 400, or thongs, to be placed on the device 100. The undergarments 400 may be conveniently and efficiently stacked on top of one another. As they are subjected to tensional force when the device 100 is in use, they do not bunch or tangle with one another, regardless of how wet a thong is. To remove, a user simply slides at least one of the retention members 104, 106, 108 and removes the attached portion of the undergarment.

Figure 5:
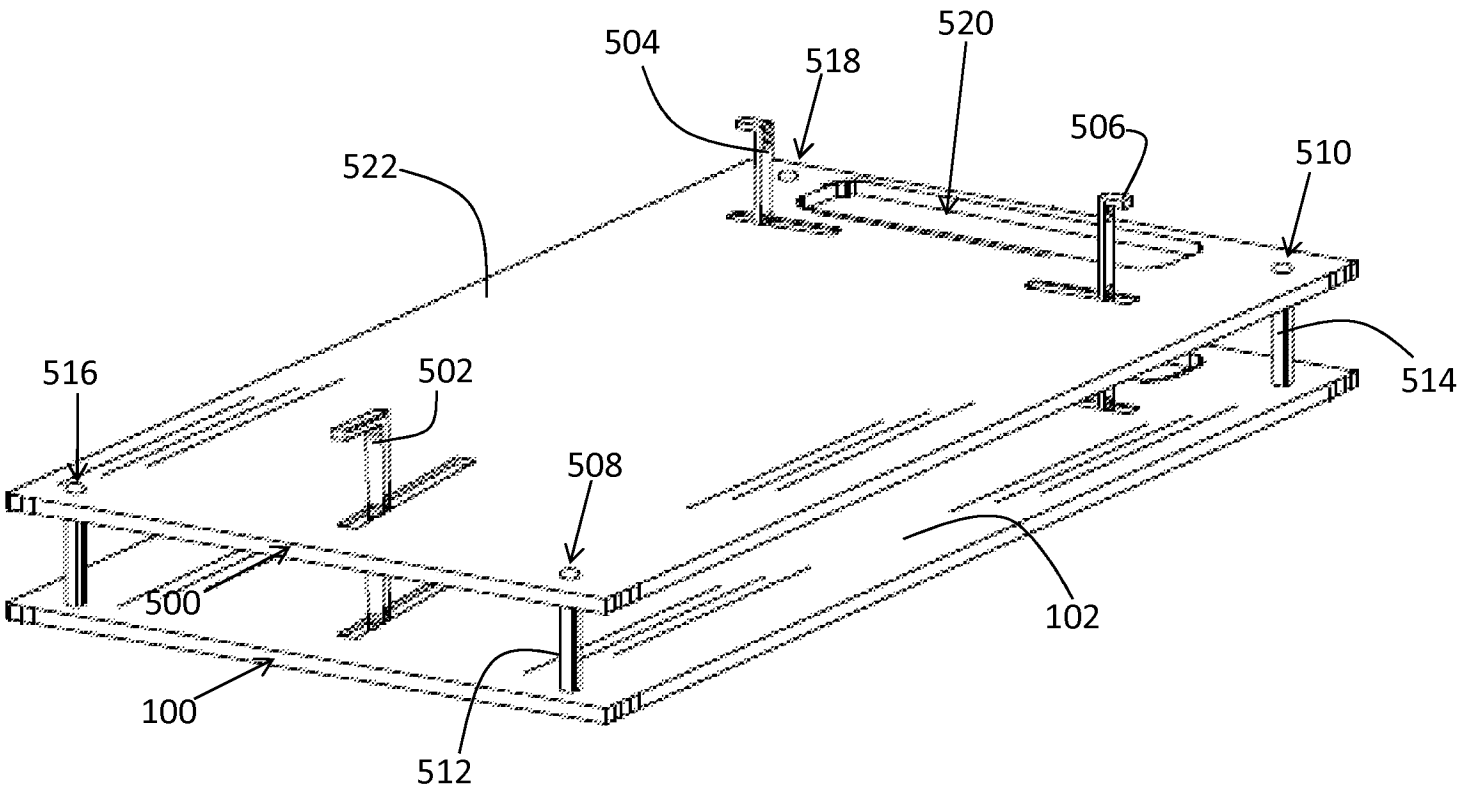

With reference now to FIG. 5, another embodiment of the present invention is shown. Contrary to many undergarment storage devices that make it incapable to conveniently store and organize undergarments, the device 100 may be have a second undergarment organizing device 500 coupled thereto. The second undergarment organizing device 500 may have all or most of the above-described features or components as the undergarment organizing device 100 that is coupled thereto. As the second undergarment organizing device 500 also effectively stores and organizes undergarments in accordance with the present invention, it too has at least three retention members 502, 504, 506.

In one embodiment, the outer surface (not shown) of the second undergarment organizing device 500 has a first portion 508 and a second portion 510 shaped to engage with the undergarment organizing device 100. Although FIG. 5 illustrates the first and second portions 508, 510 of the second undergarment organizing device 500 being two apertures sized to receive posts 512, 514 attached to the device 100. The second undergarment organizing device 500 may couple with the device 100 using dowel pins slid through the posts 512, 514, by using an aperture that is tapered to lock with the posts 512, 514, or other method(s). In other embodiments, the second undergarment organizing device 500 may have multiple other portions, e.g., 516, 518, shaped to engage or couple to the device 100. Moreover, in additional embodiments, the retention members 104, 106, 108 of the device 100 may be utilized to couple the device 100 with the second undergarment organizing device 500.

In additional embodiments, the devices 100, 500 may have a handle portion 520. This handle portion 520 permits the user to lift or carry the device conveniently and effectively. The handle portion 520 may be placed on any portion of the frame 102, 522, preferably outside of the area where the undergarment 300 is being stored and retained. Although the devices 100, 500 are shown coupled to one another, the present invention permits a user with versatility in placement, use, and configuration of the devices 100, 500. For example, one or more of the devices 100, 500 may be placed on a stand, tacked to a wall surface, placed within a drawer, may have logos or other advertisements, in addition to other uses and applications.

Figure 6:
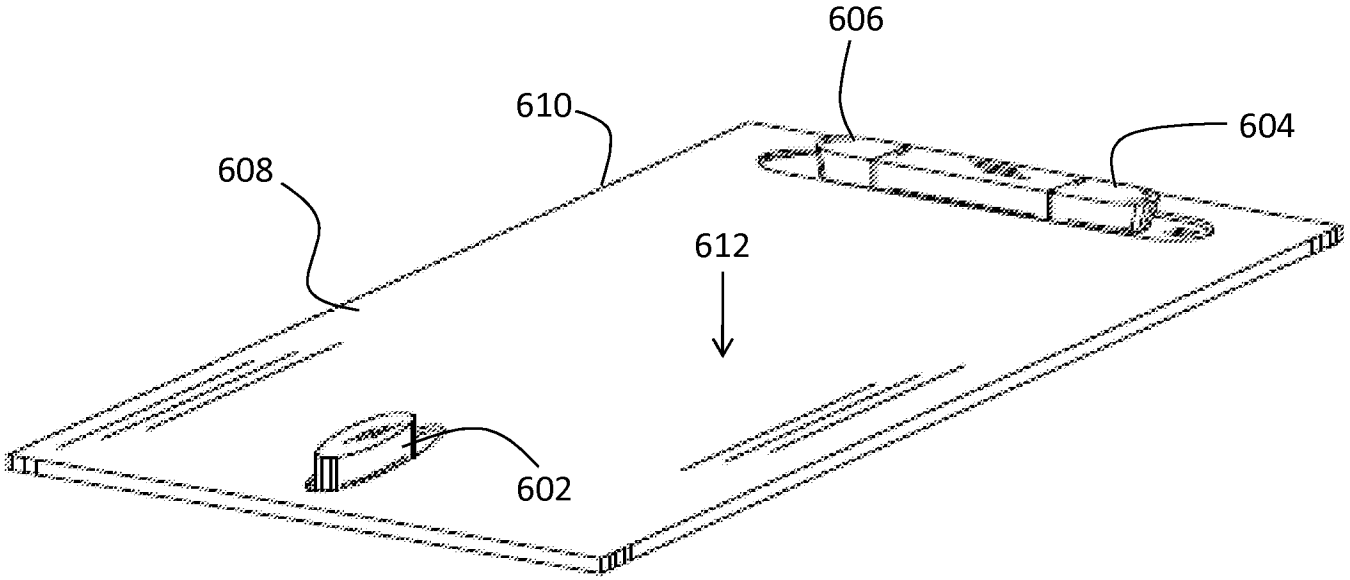
FIG. 6 is a perspective view of an undergarment organizing device with three retention members in accordance with an embodiment of the present invention.
Figure 7:
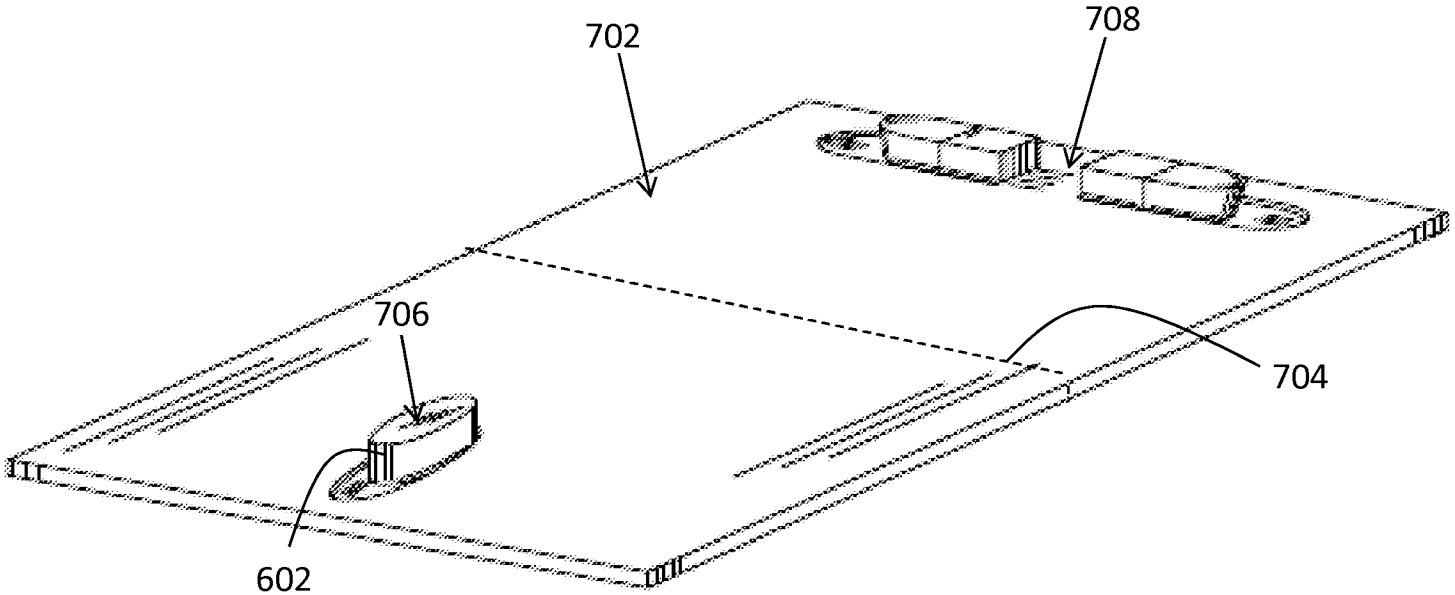
FIG. 7 is a perspective view of an undergarment device with a frame having a partition line separating a first and second half of the frame in accordance with an embodiment of the present invention.

FIGS. 6 and 7 illustrate additional embodiments of an undergarment organizing device 600. FIG. 6 shows three retention members 602, 604, 606 used to retain an undergarment(s). As shown in FIG. 6, each retention members 602, 604, 606 may be operable to slidably engage with an undergarment, thereby placing tensional force(s) on the undergarment. The two retention members 604, 606 beyond the first retention member 602 are able to recede within a cavity formed by the frame 608 of the device 600. Again, one or more of the retention members 602, 604, 606 may also be slidably biased in a direction toward an adjacent frame edge, e.g., frame edge 610 for the third retention member 606.

FIG. 7 illustrates one embodiment of the device 700 wherein the frame 702 is foldable along a partition line 704. As shown, the device 700 may be folded such that the distal end 706 of the lower retention member 602 will contact or couple to the frame 702. As depicted in FIG. 7, the frame 702 has a section 708 shaped to receive the lower retention member 602. This advantageously allows the frame 702 to be folded in half for easy transportation and even more efficient storing capability. In other embodiments, there may be a plurality of partition lines 704, placed in other locations on the frame 702, such that the frame 702 may be folded in multiple configurations. In one embodiment, the frame 702 may also have one or more hooks positioned by the partition line 704 to provide a retention means for the undergarments when the device 700 is folded. This would prevent the undergarments from being dislodged or loose during transport or storage. In other embodiments, the device 700 may have wire ties or any other fastening means.

With reference to back to FIG. 6, in further exemplary embodiments the frame 608 may be utilized to carry one or more brassieres, or brassiere-like undergarments, e.g., bikini top. It is well known that most brassieres include two cup portions that support a woman's breasts and an attachment portion. The attachment portion generally includes shoulders straps and a chest straps that extends around a woman's chest and couple together at a woman's back with clasps. As such, the frame 608 would not have the retention members 602, 604, 606. Rather, the frame 702 includes two protrusions that extend outwardly from the outer surface 612 of the frame 608, the protrusions being sized to substantially contour a particular sized cup of a brassiere, e.g., A-Cup, B-Cup, etc. In one embodiment, the protrusions may be adjustable to contour different cup sizes. For example, the protrusions may have a telescoping ability to increase their height and width with respect to the outer surface 612 or may be made with a freely deformable material that allows for deformation, e.g., elastomers. In additional embodiments, the protrusions may be removable and replaced with various sized protrusions, dependent on the cup size of the brassiere desired to be retained.

In one embodiment, the chest straps are wrapped around the frame 608 and clasped together to retain the brassiere to the frame 608. The tension generated in the brassiere is sufficient to prevent the brassiere from varying its position on, or becoming dislodged from, the frame. The frame 608 may also have apertures or slots that permit the straps of the brassiere to be funneled through or guided to the back of the frame 608 to be coupled together. The frame 608 may also have one or more retention members extending outwardly from the frame 608 to sufficient retain the brassiere. As such, the frame 608 may advantageously display and store multiple brassieres more effectively and efficiently than those known prior-art methods and devices, e.g., manikins or dresser drawers. Beneficially, the frame 608 may have multiple protrusions extending along a length of the frame 608 to retain a plurality of brassieres. In accordance with the present disclosure, multiple frames 608 may also be stacked on top of each other to organize, display, and store brassieres more efficiently than those known prior-art devices and methods.

Figure 8:
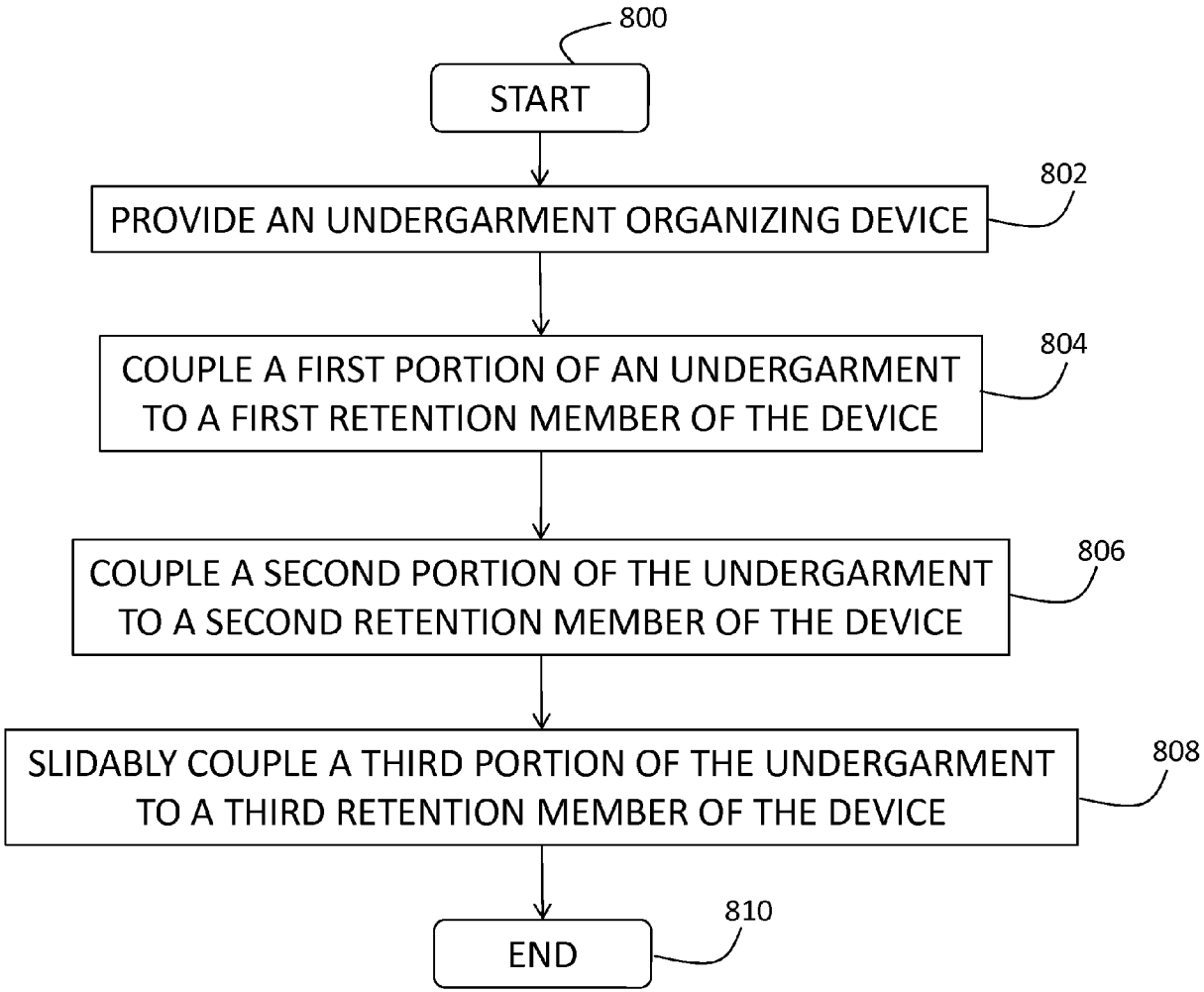
FIG. 8 is a process flow diagram representing a process of storing and retaining undergarments in accordance with the present invention.

FIG. 8 is a process flow diagram depicting the novel method of the storing and retaining undergarments. The process starts at step 800 and immediately proceeds to step 802 where an undergarment device is provided. The undergarment device may have all or many of the above-described characteristics, components, or features. The process proceeds to step 804 of coupling a first portion of an undergarment with the first retention member of the device. Next, step 806 includes coupling a second portion of the undergarment with the second retention member. Should the second retention member be slidable in a direction toward the outer frame edge, as described above, the second retention member may be slidably couplable with the second portion of the undergarment. The next step 808 includes slidably coupling the third retention member with a third portion of the undergarment. Should the first retention member also be slidable toward an outer frame edge, the first retention member may also slidably couple with the first portion of the undergarment. The process terminates at step 810.

An undergarment organizing and storing device has been disclosed that advantageously retains and stores panties and thongs for a user. Opposed to previous organizing devices, the present invention provides a device capable of retaining and storing undergarments of various sizes so they do not become tangled and bunched together. A user simply slides one of the retention members to remove or include an undergarment and to apply tensional force to any undergarment being retained. In addition to the above, the ergonomic device provides a user with the ability to effectively store undergarments in drawers or cabinets with maintaining maximum spatial efficiency.

What is claimed is:

1. An undergarment organizing device comprising:

a frame having an inner surface and outer surface;

a first retention member extending outwardly away from the inner surface of the frame, the first retention member having a first undergarment support surface;

a second retention member extending outwardly away from the inner surface of the frame, the second retention member located beyond the first retention member and having a second undergarment support surface; and a third retention member disposed within a channel defined by the frame and extending outwardly away from the inner surface of the frame, the third retention member located beyond the first retention member, having a third undergarment support surface, and being slidable in the channel defined by the frame in a direction away from the second support surface.

2. The undergarment organizing device according to claim 1, wherein:

the first, second, and third retention members are positioned on the frame in a triangular configuration.

3. The undergarment organizing device according to claim 1, wherein:

the first retention member is slidable in a direction away from both the second and third retention members.

4. The undergarment organizing device according to claim 1, wherein:

the second retention member is slidable in a direction away from the third support surface.

5. The undergarment organizing device according to claim 4, wherein:

the first retention member is slidable in a direction away from both the second and third retention members.

6. The undergarment organizing device according to claim 1, wherein:

the frame is slender.

7. The undergarment organizing device according to claim 1, further comprising:

an upper retention member coupled substantially at a distal end of at least one of the first, second, and third retention members, the upper retention member extending in a direction outwardly away from the undergarment support surface of the at least one of the first, second, and third retention members.

8. The undergarment organizing device according to claim 1, further comprising:

a second undergarment organizing device, an outer surface of the second undergarment organizing device having a first portion and a second portion, wherein the first and second portions are shaped to couple with the undergarment organizing device.

9. In combination with an undergarment having a first portion, a second portion, and a third portion, wherein an undergarment organizing device improvement comprises:

a frame having an inner surface and outer surface; and at least three retention members with:

each extending in a direction outwardly away from the inner surface of the frame;

one of the at least three retention members coupled to the first portion of the undergarment;

one of the at least three retention members coupled to the second portion of the undergarment, the second portion of the undergarment located beyond the first portion of the undergarment;

one of the at least three retention members coupled to the third portion of the undergarment, the third portion of the undergarment located beyond the first portion of the undergarment; and one of the at least three retention members disposed within a channel defined by the frame being operable to slidably, in the channel, engage with the undergarment to at least partially place the undergarment in a dynamic state.

10. The undergarment organizing device according to claim 9, wherein:

two of the at least three retention members are operable to slidably engage with the undergarment to at least partially place the undergarment in the dynamic state.

11. The undergarment organizing device according to claim 9, wherein:

three of the at least three retention members are operable to slidably couple with the undergarment to at least partially place the undergarment in the dynamic state.

12. The undergarment organizing device according to claim 9, wherein:

the at least three retention members are positioned in a triangular configuration on the frame.

13. The undergarment organizing device according to claim 12, wherein:

two of the at least three retention members are operable to slidably couple with the undergarment to at least partially place the undergarment in the dynamic state.

14. The undergarment organizing device according to claim 13, wherein:

three of the at least three retention members are operable to slidably couple with the undergarment to at least partially place the undergarment in the dynamic state.

15. The undergarment organizing device according to claim 9, wherein:

the frame is slender.

16. The undergarment organizing device according to claim 9, wherein:

one of the at least three retention members is slidably biased toward an edge of the frame.

17. The undergarment organizing device according to claim 9, wherein:

two of the at least three retention members are slidably biased toward an edge of the frame.

18. A method of the storing and retaining undergarments, the method comprising:

providing an undergarment organizing device, the undergarment organizing device having:

a frame with an inner surface and an outer surface; and a first retention member, a second retention member located beyond the first retention member, and a third retention member disposed within a channel defined by the frame located beyond the first retention member and being slidable in the channel defined by the frame in a direction toward an outer frame edge, the first, second, and third retention members extending in a direction outwardly away from the inner surface of the frame; and coupling the first retention member to a first portion of an undergarment;

coupling the second retention member to a second portion of the undergarment; and slidably coupling the third retention member to a third portion of the undergarment.

19. The method according to claim 18, wherein the second retention member is slidable in a direction toward an outer frame edge, the method further comprising:

slidably coupling the second retention member to the second portion of the undergarment.

20. The method according to claim 18, wherein the first retention member is slidable in a direction toward an outer frame edge, the method further comprising:

slidably coupling the third retention member to the third portion of the undergarment.

* * * * *